US011070034B2

(12) United States Patent
Kinoshita

(10) Patent No.: US 11,070,034 B2
(45) Date of Patent: Jul. 20, 2021

(54) METHOD FOR CONTROLLING AN IONIC WIND GENERATOR WITH AN AC POWER SOURCE AND A DC POWER SOURCE

(71) Applicant: TOYOTA JIDOSHA KABUSHIKI KAISHA, Toyota (JP)

(72) Inventor: Yohei Kinoshita, Shizuoka (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 82 days.

(21) Appl. No.: 16/525,713

(22) Filed: Jul. 30, 2019

(65) Prior Publication Data

US 2020/0052468 A1 Feb. 13, 2020

(30) Foreign Application Priority Data

Aug. 7, 2018 (JP) ..... JP2018-148435

(51) Int. Cl.
*H01T 23/00* (2006.01)

(52) U.S. Cl.
CPC ..... *H01T 23/00* (2013.01)

(58) Field of Classification Search
CPC ..... H01J 37/08; H01J 2237/036; H01T 23/00; H01T 19/00; H05H 1/2406; H05H 2001/2412; H05H 2001/2425; H05H 2001/2437
See application file for complete search history.

(56) References Cited

U.S. PATENT DOCUMENTS

2013/0083446 A1* 4/2013 Yagi ..... H01T 19/00 361/231

FOREIGN PATENT DOCUMENTS

JP 01276160 A * 11/1989
JP 2009-247966 A 10/2009
JP 2013-077750 A 4/2013

OTHER PUBLICATIONS (International Journal of Gas Turbine, Propulsion and Power Systems [online]. gtsj.org [retrieved on Feb. 2017]. Retrieved from the Internet: <URL: http://www.gtsj.org/english/jgpp/v09n01tp01.pdf> (Year: 2017).*
Plasma actuators for aeronautics applications—State of art review [online] iesj.org [retrieved on Jan. 2008]. Retrieved from the Internet: <URL: http://www.iesj.org/content/files/pdf/IJPEST_Vol2_No1_01_pp1-25.pdf> (Year: 2008).*
(Continued)

*Primary Examiner* — Jared Fureman
*Assistant Examiner* — Nicolas Bellido
(74) *Attorney, Agent, or Firm* — Dickinson Wright, PLLC

(57) ABSTRACT

The present invention relates to a method for controlling the ionic wind generator. comprising an electrode body 10, an AC power source 20, and a DC power source 30. The electrode body 10 has a first electrode layer 12, a second electrode layer 14, a third electrode layer 16, and a dielectric layer 18, such that when a voltage is applied between the first electrode layer 12 and the second electrode layer 14 by the AC power source 20, and a voltage is applied between the second electrode layer 14 and the third electrode layer 16 by the DC power source 30, an ionic wind can be generated in a direction away from the dielectric layer 18. An AC voltage is preferably set to 6 to 20 kVpp, and a DC voltage is preferably set to 6 to 20 kV.

1 Claim, 3 Drawing Sheets

(56) References Cited

OTHER PUBLICATIONS (6th AIAA Flow Control Conference[online]. arc.aiaa.org [retrieved on Jun. 2012]. Retrieved from the Internet: <URL:https://arc.aiaa.org/doi/pdf/10.2514/6.2012-3238> (Year: 2012).*

Ai Fukuda et al., "Influence of AC Voltage Waveform on Induced Jet from Multi-Electrode Plasma Actuator," The Japan Society of Mechanical Engineers, 2017 Annual Journal of the Society of Mechanical Engineers, No. 17-1, S0530102, Sep. 3-6, 2017.

Takashi Matsuno et al., "Jet Vectoring and Enhancement of Flow Control Performance of Trielectrode Plasma Actuator Utilizing Sliding Discharge," 2012-3238, 6th AIAA Flow Control Conference, Jun. 25-28, 2012.

* cited by examiner

METHOD FOR CONTROLLING AN IONIC WIND GENERATOR WITH AN AC POWER SOURCE AND A DC POWER SOURCE

FIELD

The present invention relates to a method of controlling an ionic wind generator.

BACKGROUND OF THE INVENTION

In metal electrode/insulator/metal electrode structures, applying a voltage across metal electrodes to charge the air and create an ionic wind is known.

Patent document 1 discloses an air flow generating device, wherein at least one of two electrodes provided on the surfaces of a planar dielectric has multiple ends, an AC voltage is applied to both electrodes, and one of the electrodes is grounded, whereby an ionic wind is induced. Patent document 1 describes that the air flow generating device (1) has an effect of inducing plasma to the grounded electrode disposed on the opposing surface of the planar dielectric interposed therebetween by applying high voltage to one of the electrodes, and (2) has an effect of stabilizing the plasma form, and simultaneously inducing blowing forces from the electrode on the planar dielectric towards the plate ground electrode by applying an AC voltage to the electrode, causing an ionic wind to be created on the planar dielectric.

Additionally, such ionic winds are used as a means of exchanging heat. For example, Patent document 2 describes a heat exchanger comprising an electron emitter element having an electrode substrate and a thin film electrode and an electron acceleration layer interposed between the electrode substrate and the thin film electrode, and a hole electrode having at least one through-hole and facing apart from the thin film electrode, wherein the electron emitter element and the hole electrode are arranged in air, a first voltage is applied between the electrode substrate and the thin film electrode, a second voltage is applied between the thin film electrode and the hole electrode, the first voltage causes electrons generated in the electrode substrate to be accelerated by the electron acceleration layer and then released from the thin film electrode into the air, generating negative ions, and the second voltage causes generation of an ionic wind containing the negative ions, whereby the wind passes through the through-hole and is emitted toward a heat exchange body.

In recent years, three-electrode ionic wind generation devices have also been proposed.

Non-Patent document 1 discloses a three-electrode plasma actuator in which an AC voltage of 15.6 kVpp and a DC voltage of 0 to 30 kV are applied at frequencies of 6 kHz, 7 kHz, and 13 to 18 kHz. Additionally, Non-Patent document 1 discloses that the distance between the AC electrode and the DC electrode is 40 mm, 60 mm, or 80 mm.

Non-Patent document 2 discloses applying an AC voltage of 10.4 to 20.8 kV and a DC voltage of 0 to 20 kV in a three-electrode plasma actuator. Additionally, Non-Patent document 2 discloses that the distance between the AC electrode and the DC electrode is 40 mm.

CITATION LIST

Patent Literature

[Patent document 1] JP 2009-247966A
[Patent document 2] JP 2013-077750A

NON-PATENT LITERATURE

[Non-Patent document 1] The Japan Society of Mechanical Engineers, 2017 Annual Journal of the Society of Mechanical Engineers No. 17-1: 50530102
[Non-Patent document 2] 2012-3238. $6^{th}$-AIAA Flow Control Conference, Jun. 25 to 28, 2012.

SUMMARY OF THE INVENTION

Problem to be Solved by the Invention

There is room for improvement in both the wind speed (body force) of the ionic wind, and reducing electric power consumption during generation of the ionic wind.

Thus, there is a need to provide a method for controlling an ionic wind generator that can achieve an ionic wind with a high body force using reduced electric power.

Means for Solving the Problem

Upon keen investigation, the present inventors have discovered that the above problem can be solved by the following means and thereby completed the invention. Essentially, the present invention is as follows:

<Aspect 1> A method for controlling an ionic wind generator, the ionic wind generator comprising:

an electrode body, an AC power source, and a DC power source, wherein the electrode body has a first electrode layer, a second electrode layer, a third electrode layer, and a dielectric layer, the AC power source is connected between the first electrode layer and the second electrode layer, whereby a voltage can be applied between these electrode layers, the DC power source is connected between the second electrode layer and the third electrode layer, whereby a voltage can be applied between these electrode layers, the first and third electrode layers are arranged on a portion of a surface of the dielectric layer, opposite to one another and substantially parallel with one another, the distance between the first electrode layer and the third electrode layer is 11 to 35 mm, the second electrode layer is arranged on a portion of the other surface of the dielectric layer, such that when a voltage is applied between the first electrode layer and the second electrode layer by the AC power source, and a voltage is applied between the second electrode layer and the third electrode layer by the DC power source, an ionic wind can be generated in a direction away from the dielectric layer, an AC voltage applied between the first electrode layer and the second electrode layer by the AC power source is set to 6 to 20 kVpp, and a DC voltage applied between the second electrode layer and the third electrode layer by the DC power source is set to 6 to 20 kV.

<Aspect 2> The method for controlling an ionic wind generator according to Aspect 1, wherein the AC voltage is set to 11 to 20 kVpp.

Effects of Invention

The present invention provides a method for controlling an ionic wind generator which can achieve an ionic wind with a high body force using reduced electric power.

BRIEF DESCRIPTION OF THE DRAWINGS

FIG. 1A shows a side cross-sectional view of the ionic wind generator, and FIG. 1B shows-a top view of the ionic wind generator.

DESCRIPTION OF THE EMBODIMENTS

Figure 1A:
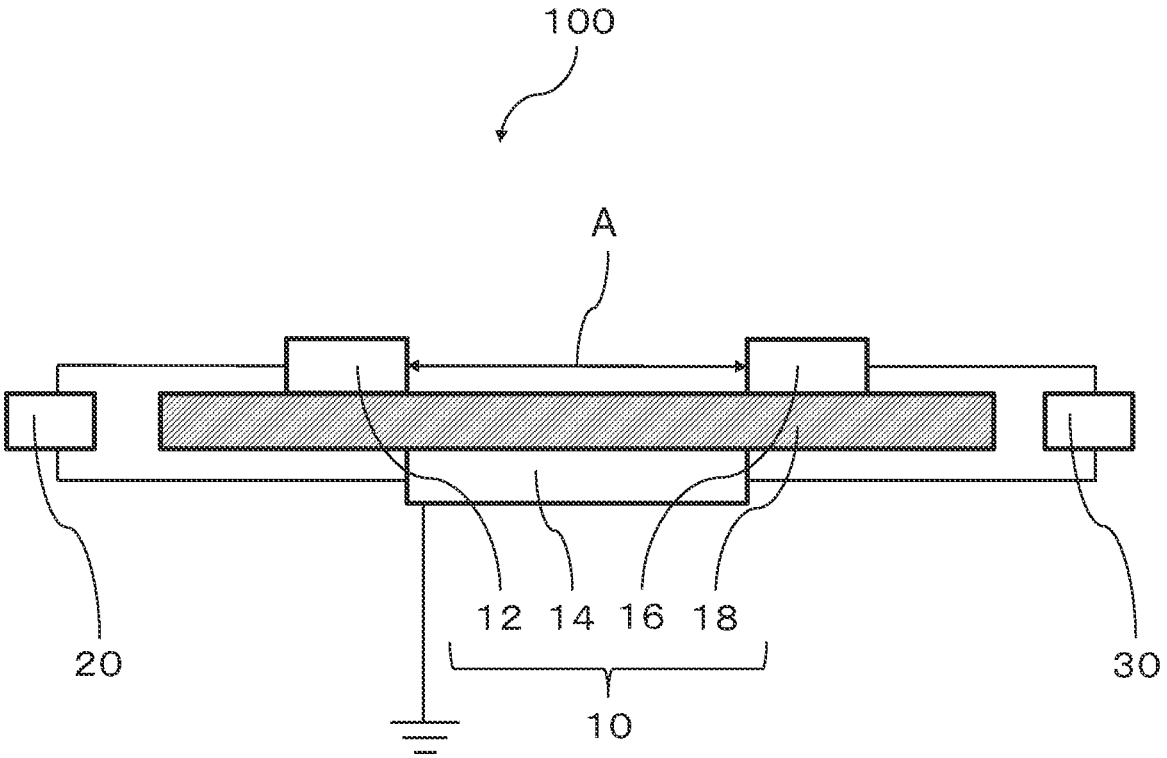
FIGS. 1A and 1B are schematic diagrams of the ionic wind generator.

<Method for Controlling the Ionic Wind Generator>

The method for controlling the ionic wind generator of the present invention will be described with reference to FIGS. 1A and 1B, which illustrate an exemplary embodiment. In the method:

an ionic wind generator 100 comprises:

an electrode body 10, an AC power source 20, and a DC power source 30, the electrode body 10 has a first electrode layer 12, a second electrode layer 14, a third electrode layer 16, and a dielectric layer 18, the AC power source 20 is connected between the first electrode layer 12 and the second electrode layer 14, whereby a voltage can be applied between these electrode layers, the DC power source 30 is connected between the second electrode layer 14 and the third electrode layer 16, whereby a voltage can be applied between these electrode layers, the first electrode layer 12 and the third electrode layer 16 are arranged on a portion of a surface of the dielectric layer, opposite to one another and substantially parallel with one another, the distance between the first electrode layer 12 and the third electrode layer 16 is 11 to 35 mm, the second electrode layer 14 is arranged on a portion of the other surface of the dielectric layer 18, such that when a voltage is applied between the first electrode layer 12 and the second electrode layer 14 by the AC power source 20, and a voltage is applied between the second electrode layer 14 and the third electrode layer 16 by the DC power source 30, an ionic wind can be generated in a direction away from the dielectric layer 18, an AC voltage applied between the first electrode layer 12 and the second electrode layer 14 by the AC power source 20 is set to 6 to 20 kVpp, and a DC voltage applied between the second electrode layer 14 and the third electrode layer 16 by the DC power source 30 is set to 6 to 20 kV.

Figure 2A:
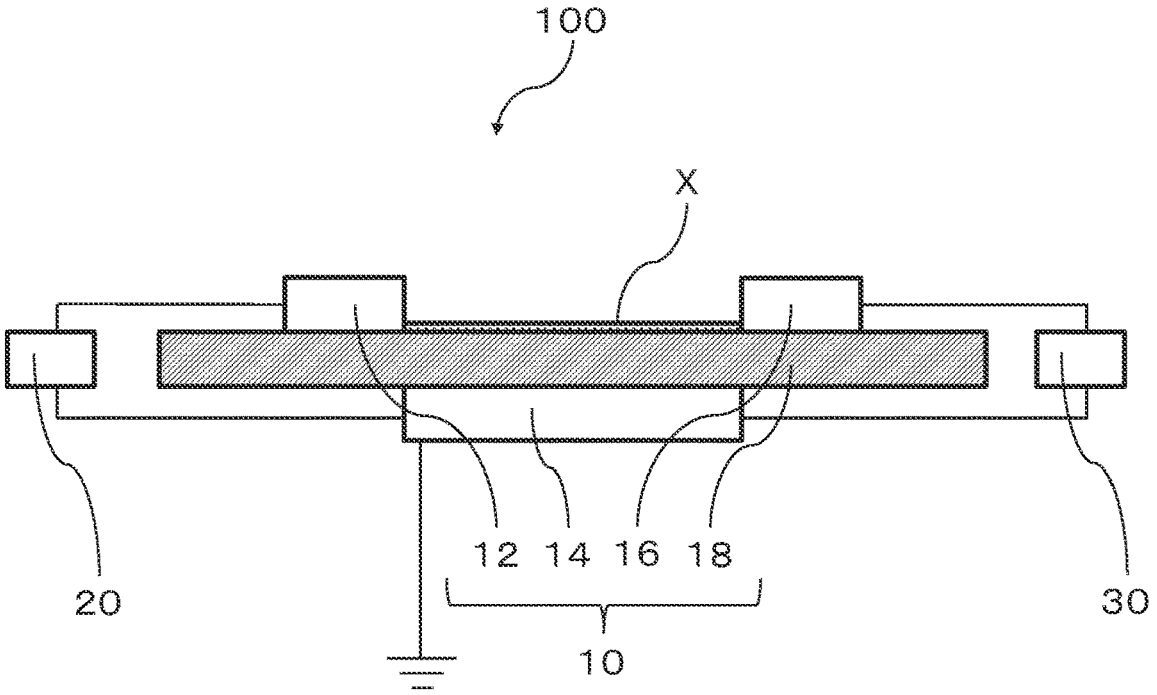
FIGS. 2A and 2B are conceptual diagrams of the generation of ionic wind by the ionic wind generator.
Figure 2B:
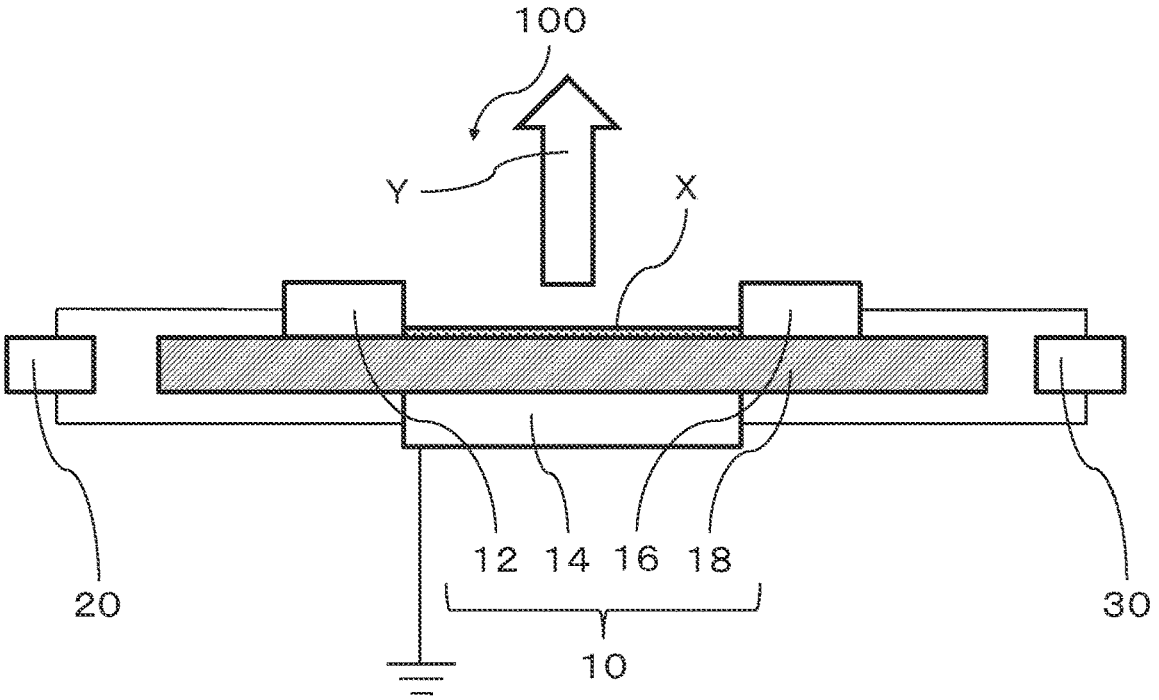

The present inventors have discovered that an ionic wind with high body force using reduced electric power can be obtained by the above method. Without being bound by theory, it is believed that when the distance between the first electrode layer and the third electrode layer is 11 to 35 mm and an AC voltage is applied between the first electrode layer and the second electrode layer, an electrolytic film X is formed between the first electrode layer 12 and the third electrode layer 16, as shown in FIG. 2A, and as a result, ionization of the molecules in air is promoted and ions are deposited. It is also believed that when a DC voltage is applied between the second electrode layer and the third electrode layer in this state, the ions are ejected by the DC voltage, as shown in FIG. 2B, such that even a weak DC voltage can produce an ionic wind with a high body force.

The AC voltage (peak to peak) applied by the AC power source between the first electrode layer and the second electrode layer is preferably 11 kVpp or higher, 12 kVpp or higher, or 13 kVpp or higher from the viewpoint of suitably forming the aforementioned electrolytic film by the AC voltage, and is preferably 20 kVpp or lower, 17 kVpp or lower, or 15 kVpp or lower from the viewpoint of limiting energy consumption.

The DC voltage applied by the DC power source between the second electrode layer and the third electrode layer is preferably 6 kVpp or higher, 8 kVpp or higher, 9 kVpp or higher, 10 kVpp or higher, or 11 kVpp or higher from the viewpoint of increasing the body force of the ionic wind, and is preferably 20 kVpp or lower, 17 kVpp or lower, 15 kVpp or lower, or 13 kVpp or lower from the viewpoint of limiting energy consumption.

The second electrode layer is preferably electrically grounded, from the viewpoint of safety.

The first electrode layer and the third electrode layer are arranged opposite each other and substantially parallel. In the present invention, "substantially parallel" means an angular difference of 10° or less, 5° or less, 3° or less, or 1° or less from perfectly parallel.

The distance between the first electrode layer and the third electrode layer is preferably 11 mm or more, 13 mm or more, 15 mm or more, or 18 mm or more, from the viewpoint of limiting short circuit discharges when the AC voltage is applied, and is preferably 35 mm or less, 33 mm or less, 30 mm or less, 27 mm or less, 25 mm or less, or 22 mm or less, or particularly 20 mm, from the viewpoint of suitably forming the aforementioned electrolytic film by the AC voltage.

The first and third electrode layers may have different respective lengths, or may have equal lengths, but having equal lengths is preferable from the viewpoint of manufacturing.

The second electrode layer is preferably arranged at a location corresponding to the region between the first electrode layer and the third electrode layer, from the viewpoint of suitably forming the aforementioned electrolytic film by the AC voltage.

The components of the ionic wind generator used in the method for the present invention will be described below.

<Electrode Body>

The electrode body has a first electrode layer, a second electrode layer, a third electrode layer, and a dielectric layer.

(First Electrode Layer)

The first electrode layer is an electrode layer connected to an AC power source, for example a strip-like electrode layer.

The first electrode layer may be composed of a material with electrical conductivity, for example, a metal such as zinc, aluminum, gold, silver, copper, platinum, nichrome, iridium, tungsten, nickel, or iron. Further, a conductive ink, comprising a polyester resin, epoxy resin, polyurethane resin, polyvinyl chloride resin, phenol resin, or the like, blended with a conductive paste such as a silver paste or a carbon paste can be used as the first electrode layer.

(Second Electrode Layer)

The second electrode layer is an electrode layer connected to an AC power source and a DC power source, for example a strip-like electrode layer, and is preferably electrically grounded. The second electrode layer may be composed of any of the materials described regarding the first electrode layer.

(Third Electrode Layer)

The third electrode layer is an electrode layer connected to a DC power source, for example a strip-like electrode layer. The third electrode layer may be composed of any of the materials described regarding the first electrode layer.

(Dielectric Layer)

Any insulator, for example, mica, glass, ceramic, resin, etc., can be used as the dielectric layer. The dielectric layer may be, for example, a sheet-like dielectric layer.

As the ceramic, for example, alumina, zirconia silicon nitride, or aluminum nitride, etc., can be used.

As the resin, for example, a phenol resin, urea resin, polyester, epoxy, silicon, polyethylene, polytetrafluoroethylene, polystyrene, soft PVC, hard PVC, cellulose acetate, polyethylene terephthalate, Teflon (registered trademark), natural rubber, soft rubber, ebonite, steatite, or butyl rubber, neoprene, etc., can be used.

<AC Power Source>

The AC power source is connected between the first electrode layer and the second electrode layer, and can thereby apply a voltage between these electrode layers. As long as the AC power source can apply an AC voltage of 6 to 20 kVpp, any AC power source may be used.

<DC Power Source>

The DC power source is connected between the second electrode layer and the third electrode layer, and can thereby apply a voltage between these electrode layers. As long as the DC power source can apply a DC voltage of 6 to 20 kV, any DC power source may be used.

EXAMPLES

The present invention will be specifically described by way of the Examples and Comparative Examples. However, the present invention is not limited thereto.

Production of Ionic Wind Generator

Example 1

Figure 1B:
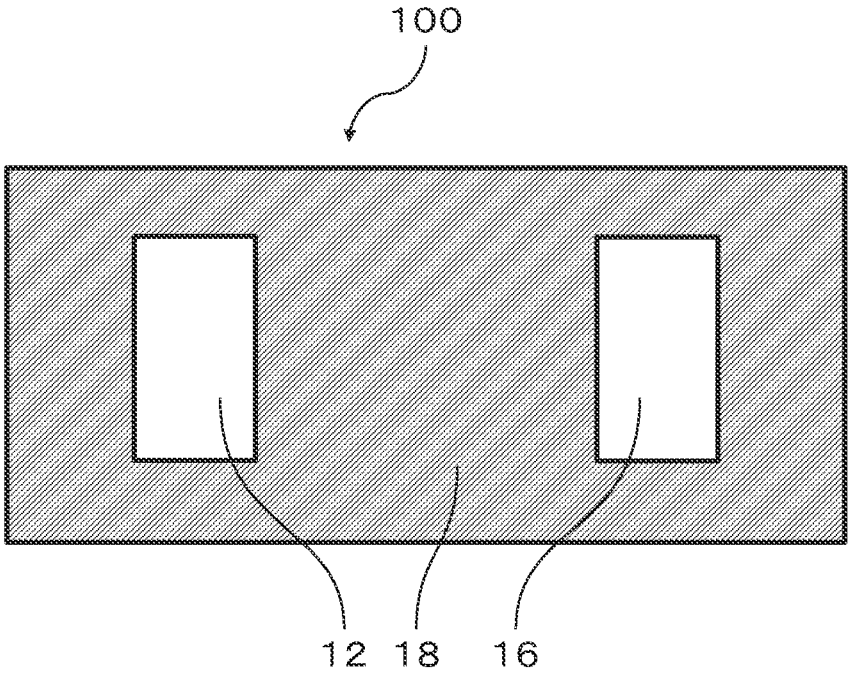

As shown in FIGS. 1A and 1B, on one surface of a polytetrafluoroethylene sheet (60×mm×60 mm, thickness 1 mm) as the dielectric layer 18, strips of aluminum tape (width 5 mm, length 35 mm) as the first electrode layer 12 and the third electrode layer 16 were placed in parallel with a 20 mm interval. In Tables 1 to 4 below, the interval between the first electrode layer and the third electrode layer is referred to as the "distance between electrodes".

Subsequently, on the other surface of the polytetrafluoroethylene sheet, a strip of aluminum tape (width 20 mm, length 35 mm) as the second electrode layer 14 was placed in a position corresponding to the region between the first electrode layer 12 and the third electrode layer 16.

Next, an AC power source was connected between the first electrode layer and the second electrode layer, a DC power source was connected between the second electrode layer and the third electrode layer, and the second electrode layer was electrically grounded, whereby the ionic wind generator of Example 1 was produced. Incidentally, the DC power source was connected such that the negative terminal was connected to the third electrode layer.

Example 2

The ionic wind generator of Example 2 was produced in a similar manner as the ionic wind generator of Example 1, except that the positive terminal of the DC power source was connected to the third electrode layer.

Comparative Examples 1 and 2

The ionic wind generators of Comparative Examples 1 and 2 were produced in a similar manner as the ionic wind generators of Examples 1 and 2 respectively, except that the interval between the first electrode layer 12 and the third electrode layer 16 was changed to 10 mm, and the width of the second electrode layer 14 was changed to 10 mm.

Comparative Example 3

The ionic wind generator of Comparative Example 3 was produced in a similar manner as the ionic wind generator of Example 1, except that the interval between the first electrode layer 12 and the third electrode layer 16 was changed to 40 to 80 mm, and the width of the second electrode layer 14 was changed to 40 to 80 mm in accordance with the interval.

Evaluation

The body force of the ionic wind was measured altering the potentials of the first and third electrode layers within the ranges shown in Table 1. The measurement of the body force of the ionic wind was performed by placing each ionic wind generator on an electric scale, such that when the ionic wind is generated, the reaction force is measured by the electric scale.

Figure 3:
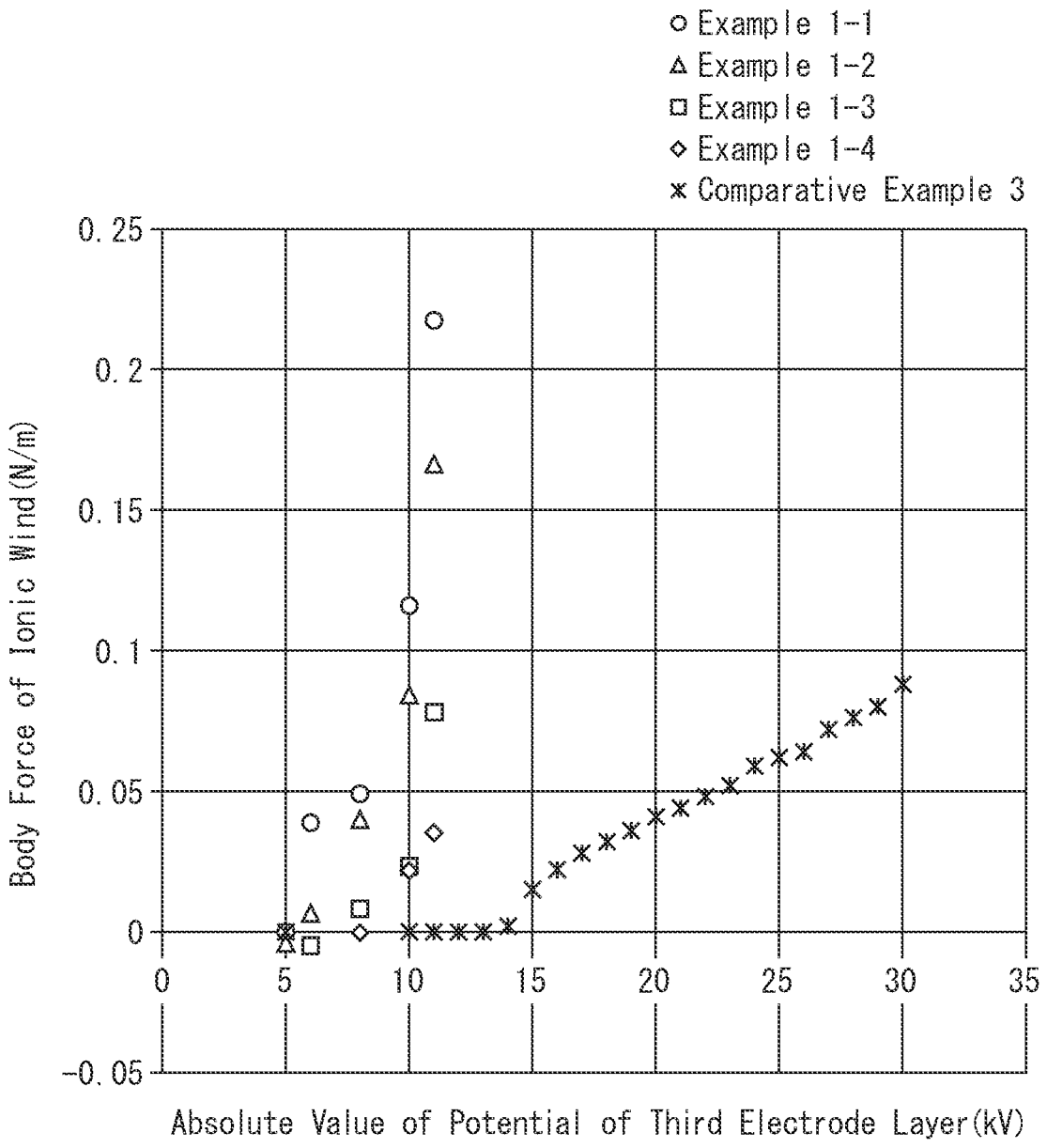
FIG. 3 is a diagram showing the relationship between body force of the ionic wind and the absolute value of the potential of the third electrode layer under the control conditions of Examples 1-1 to 1-4 and Comparative Example 3-1.

Control conditions and evaluation results are shown in Tables 1 to 4 and FIG. 3. The "GND" (ground) in Tables 1 to 4 means electrically grounded. Additionally, a negative value for the potential of the third electrode layer means that the negative terminal of the DC power source was connected to the third electrode.

Table 1 shows the maximum body force of the ionic wind when the potentials of the first and the third electrode layers were changed within the ranges shown in Table 1.

In Table 2, for the ionic wind generator of Example 1, individual results of the body force of the ionic wind were evaluated by changing the potential of the third electrode layer while the potential of the first electrode layer was set to 11 kVpp, 14 kVpp, 17 kVpp, and 20 kVpp, which are referred to respectively as Examples 1-1 to 1-4.

In Table 3, for an ionic wind generator of Comparative Example 3, individual results of the body force of the ionic wind were evaluated by changing the potential of the third electrode layer while fixing the distance between electrodes at 40 mm, which is referred to as Comparative Example 3-1.

FIG. 3 shows the relationship between the body force of the ionic wind shown in Tables 2 and 3, and the absolute value of the potential of the third electrode layer.

In Table 4, the body force of the ionic wind was individually measured by changing the potential of the first electrode layer without applying a DC voltage between the second electrode layer and the third electrode layer, which is referred to as Example 1-5.

TABLE 1

| | Control Conditions | | | | Evaluation Results |
|---|---|---|---|---|---|
| | Distance between electrodes (mm) | Potential of first electrode (kVpp) | Potential of second electrode (kV) | Potential of third electrode (kV) | Maximum body force of ionic wind (N/m) |
| Comparative Example 1 | 10 | ~20 | GND | −11~0 | 0.005 |
| Comparative Example 2 | 10 | ~20 | GND | 0~11 | 0.005 |
| Example 1 | 20 | ~20 | GND | −11~0 | 0.220 |
| Example 2 | 20 | ~20 | GND | 0~11 | 0.135 |
| Comparative Example 3 | 40~80 | 15.6 | GND | ~30 | 0.090 |

TABLE 2

| | Control Conditions | | | | Evaluation Results |
|---|---|---|---|---|---|
| | Distance between electrodes (mm) | Potential of first electrode (kVpp) | Potential of second electrode (kV) | Potential of third electrode (kV) | Maximum body force of ionic wind (N/m) |
| Example 1-1 | 20 | 11 | GND | −5 | 0.000 |
| | 20 | 11 | GND | −6 | 0.039 |
| | 20 | 11 | GND | −8 | 0.049 |
| | 20 | 11 | GND | −10 | 0.116 |
| | 20 | 11 | GND | −11 | 0.217 |
| Example 1-2 | 20 | 14 | GND | −5 | −0.004 |
| | 20 | 14 | GND | −6 | 0.007 |
| | 20 | 14 | GND | −8 | 0.040 |
| | 20 | 14 | GND | −10 | 0.084 |
| | 20 | 14 | GND | −11 | 0.166 |
| Example 1-3 | 20 | 17 | GND | −6 | −0.005 |
| | 20 | 17 | GND | −8 | 0.008 |
| | 20 | 17 | GND | −10 | 0.023 |
| | 20 | 17 | GND | −11 | 0.078 |
| Example 1-4 | 20 | 20 | GND | −8 | 0.000 |
| | 20 | 20 | GND | −10 | 0.022 |
| | 20 | 20 | GND | −11 | 0.035 |

TABLE 3

| | Control Conditions | | | | Evaluation Results |
|---|---|---|---|---|---|
| | Distance between electrodes (mm) | Potential of first electrode (kVpp) | Potential of second electrode (kV) | Potential of third electrode (kV) | Maximum body force of ionic wind (N/m) |
| Comparative Example 3-1 | 40 | 15.6 | GND | −5 | 0 |
| | 40 | 15.6 | GND | −10 | 0 |
| | 40 | 15.6 | GND | −11 | 0 |
| | 40 | 15.6 | GND | −12 | 0 |
| | 40 | 15.6 | GND | −13 | 0 |
| | 40 | 15.6 | GND | −14 | 0.002 |
| | 40 | 15.6 | GND | −15 | 0.015 |
| | 40 | 15.6 | GND | −16 | 0.022 |
| | 40 | 15.6 | GND | −17 | 0.028 |
| | 40 | 15.6 | GND | −18 | 0.032 |
| | 40 | 15.6 | GND | −19 | 0.036 |
| | 40 | 15.6 | GND | −20 | 0.041 |
| | 40 | 15.6 | GND | −21 | 0.044 |
| | 40 | 15.6 | GND | −22 | 0.048 |
| | 40 | 15.6 | GND | −23 | 0.052 |
| | 40 | 15.6 | GND | −24 | 0.059 |
| | 40 | 15.6 | GND | −25 | 0.062 |

TABLE 3-continued

| | Control Conditions | | | | Evaluation Results |
|---|---|---|---|---|---|
| | Distance between electrodes (mm) | Potential of first electrode (kVpp) | Potential of second electrode (kV) | Potential of third electrode (kV) | Maximum body force of ionic wind (N/m) |
| | 40 | 15.6 | GND | −26 | 0.064 |
| | 40 | 15.6 | GND | −27 | 0.072 |
| | 40 | 15.6 | GND | −28 | 0.076 |
| | 40 | 15.6 | GND | −29 | 0.08 |
| | 40 | 15.6 | GND | −30 | 0.088 |

TABLE 4

| | Control Conditions | | | | Evaluation Results |
|---|---|---|---|---|---|
| | Distance between electrodes (mm) | Potential of first electrode (kVpp) | Potential of second electrode (kV) | Potential of third electrode (kV) | Maximum body force of ionic wind (N/m) |
| Example 1-5 | 20 | 10 | GND | 0 | 0.000 |
| | 20 | 12 | GND | 0 | 0.000 |
| | 20 | 14 | GND | 0 | 0.000 |
| | 20 | 16 | GND | 0 | 0.003 |
| | 20 | 18 | GND | 0 | 0.006 |
| | 20 | 20 | GND | 0 | 0.008 |

From Table 1, it can be understood that the ionic wind generators of Examples 1 and 2, in which the distance between electrodes was 20 mm, generated an ionic wind with a significantly larger maximum body force than an ionic wind generated by the ionic wind generators of Comparative Examples 1 and 2, in which the distance between electrodes was 10 mm, and the ionic wind generator of Comparative Example 3, in which the distance between electrodes was 40 mm.

Further, from Tables 2 and 3 and FIG. 3, though it can be understood that, for the ionic wind generators of Examples 1-1 to 1-4 and Comparative Example 3-1, the larger the absolute value of the potential of the third electrode layer, the higher body force of ionic wind was generated, the ionic wind generator of Comparative Example 3 generated ionic wind when the absolute value of the potential of the third electrode was 15 kV or higher, whereas the ionic wind generators of Examples 1-1 to 1-4 generated ionic wind when the absolute value of the potential of the third electrode was 6 kV or higher. Thus, it can be understood that the ionic wind generators of Examples 1-1 to 1-4 achieved an ionic wind with a higher body force at reduced electric power compared with the ionic wind generator of Comparative Example 3.

Though individual results are not shown like in Examples 1-1 to 1-4, the ionic wind generator of Example 2 achieved an ionic wind with a high body force, like Examples 1-1 to 1-4.

When the ionic wind generators of Examples 1-1 to 1-4 are compared with each other, it could be confirmed that an ionic wind with a higher body force was achieved as the potential of the first electrode decreased.

From Table 4, it can be understood that ionic wind was only slightly generated when only an AC voltage was applied, thus confirming that the mutual interaction between the AC voltage and the DC voltage contributes to the generation of ionic wind.

REFERENCE SIGNS LIST

10 electrode body
12 first electrode layer
14 second electrode layer
16 third electrode layer
18 dielectric layer
20 AC power source
30 DC power source
100 ionic wind generator
A distance between the first electrode layer and the third electrode layer
X electrolytic film
Y ionic wind

The invention claimed is:

1. A method for controlling an ionic wind generator, the ionic wind generator comprising:

an electrode body, an AC power source, and a DC power source, wherein the electrode body has a first electrode layer, a second electrode layer, a third electrode layer, and a dielectric layer, the AC power source is connected between the first electrode layer and the second electrode layer, whereby an AC voltage can be applied between these electrode layers, the DC power source is connected between the second electrode layer and the third electrode layer, whereby a DC voltage can be applied between these electrode layers, the first and third electrode layers are arranged on a portion of a surface of the dielectric layer, opposite to one another and substantially parallel with one another, a distance between the first electrode layer and the third electrode layer is 18 to 22 mm, the second electrode layer is arranged on a portion of another surface of the dielectric layer, such that when the AC voltage is applied between the first electrode layer and the second electrode layer by the AC power source, and the DC voltage is applied between the second electrode layer and the third electrode layer by the DC power source, an ionic wind can be generated in a direction away from the dielectric layer, the AC voltage applied between the first electrode layer and the second electrode layer by the AC power source is set to 11 to 15 kVpp, and the DC voltage applied between the second electrode layer and the third electrode layer by the DC power source is set to 11 to 13 kV.

* * * * *